US005373300A

United States Patent [19]

Jenness et al.

[11] Patent Number: 5,373,300

[45] Date of Patent: Dec. 13, 1994

[54] MOBILE DATA TERMINAL WITH EXTERNAL ANTENNA

[75] Inventors: Robert V. Jenness, Boca Raton; Victor S. Moore, Delray Beach, both of Fla.

[73] Assignee: International Business Machines Corporation, Armonk, N.Y.

[21] Appl. No.: 887,434

[22] Filed: May 21, 1992

[51] Int. Cl.[5] ..... H01Q 1/24

[52] U.S. Cl. ..... 343/102; 343/873; 455/89

[58] Field of Search ..... 343/702, 784, 789, 700 MS, 343/873, 788, 905; 455/83, 89, 90, 269, 272, 274; 312/223.2, 351.2; H01Q 1/24

[56] References Cited

U.S. PATENT DOCUMENTS

| | | | |
|---|---|---|---|
| 2,785,399 | 3/1957 | Harris | 343/873 |
| 4,584,709 | 4/1986 | Kneisel et al. | 455/78 |
| 4,644,366 | 2/1987 | Scholz | 343/702 |
| 4,914,449 | 4/1990 | Fukuzawa et al. | 343/700 MS |
| 5,138,328 | 8/1992 | Zibrik et al. | 343/702 |

*Primary Examiner*—Donald Hajec
*Assistant Examiner*—Tan Ho
*Attorney, Agent, or Firm*—Ray Strimaitis; Andrew J. Dillon

[57] ABSTRACT

A mobile data terminal external antenna is disclosed for use with a battery powered data processing terminal which includes a radio frequency communication device, such as a cellular telephone transceiver. Multiple antenna elements are mounted within a D-shaped flexible tubular member having a very low dielectric constant which is then affixed to the external surface of the data processing terminal, utilizing an adhesive on the flat surface thereof. The flexible tubular member is preferably mounted along at least two edges of the data processing terminal display module such that spatial or polarization diversity for the multiple antenna elements may be provided. A coaxial connector is utilized to couple the multiple antenna elements to a radio frequency communication device within the data processing terminal. In this matter, an external antenna may be added to a battery powered data processing terminal in a manner which will protect the antenna without interfering with radio frequency transmission or reception while simultaneously providing additional protection for the data processing terminal.

10 Claims, 2 Drawing Sheets

MOBILE DATA TERMINAL WITH EXTERNAL ANTENNA

BACKGROUND OF THE INVENTION

1. Technical Field

The present invention relates in general to improvements in mobile data terminals and in particular to improvements in an external radio frequency antenna for utilization with a mobile data terminal. Still more particularly, the present invention relates to a flexible external radio frequency antenna which may be rapidly and efficiently affixed to a mobile data terminal.

2. Description of the Related Art

Distributed data processing systems are increasingly common in the modern electronic work place. Such distributed data processing systems may include thousands of computers or workstations including main frame computers, so-called "personal" computers, and modern state-of-the-art portable or "laptop" computers. In modern distributed data processing systems many such computers may be linked together utilizing various topologies and different types of networks including Advanced-Peer-To-Peer-Networks (APPN), Local Area Networks (LAN) or various other types of networks. While in the past computer networks are generally coupled together utilizing existing telephone land line systems, or specialized wiring, modern distributed data processing systems often utilize more sophisticated means of communication.

For example, the increasing efficiency and decreasing cost of cellular communication equipment has resulted in the utilization of that technology to couple together multiple computers without the necessity of access to a telephone line outlet. This particular technology is particularly effective in combination with small, portable battery powered laptop or notebook computer in which the necessary modem and cellular communication circuitry are miniaturized and provided in an integral fashion with the computer itself. Often in such a computer, it is possible to remove the fixed disk drive and replace that subassembly with a combination modem and cellular communications device such that the data processing terminal may be coupled to a large network utilizing cellular communications technology. Thus, an operator utilizing such a computer may initiate communications and transfer data between his or her computer and a distributed data processing system without the necessity of access to either telephone lines or power lines.

The increasing utilization of such devices and the after market refitting of existing laptop or notebook type computers with such communications modules result in a problem in the efficiency of the radio frequency communication. That is, devices which are initially designed for utilization with cellular communication circuitry are constructed with internal antenna elements which are optimized for cellular communications; however, the after market refitting of a laptop or notebook computer with a combination modem and cellular communication device often causes a problem, since such devices were not designed initially for cellular communication network linking.

The antenna devices typically utilized for cellular communication generally compose multiple antenna elements, each including a radiating element which is equal in length to some fraction of the wavelength generally utilized by the cellular communication device. Further, in order to enhance the efficiency of communication, these multiple antenna elements must include elements which are separated by a minimum distance and preferably must be oriented normal to each other in space, in order to provide the necessary separation and spatial diversity.

Thus, upon reference to the foregoing it should be apparent to those skilled in the art that a need exists for an external antenna which may be rapidly and efficiently affixed to a portable data processing terminal in a manner which provides optimum radio frequency communication.

SUMMARY OF THE INVENTION

It is therefore one object of the present invention to provide an improved mobile data terminal.

It is another object of the present invention to provide an improved external radio frequency antenna for utilization with a mobile data terminal.

It is yet another object of the present invention to provide a flexible external radio frequency antenna which may be rapidly and efficiently affixed to a mobile data terminal.

The foregoing objects are achieved as is now described. The mobile data terminal with external antenna of the present invention may be implemented utilizing any battery powered data processing terminal which includes a radio frequency communication device, such as a cellular telephone transceiver. Multiple antenna elements are mounted within a D-shaped flexible tubular member having a very low dielectric constant which is then affixed to the external surface of the data processing terminal, utilizing an adhesive on the flat surface thereof. The flexible tubular member is preferably mounted along at least two edges of the data processing terminal display module such that spatial or polarization diversity for the multiple antenna elements may be provided. A coaxial connector is utilized to couple the multiple antenna elements to a radio frequency communication device within the data processing terminal. In this matter, an external antenna may be added to a battery powered data processing terminal in a manner which will protect the antenna without interfering with radio frequency transmission or reception while simultaneously providing additional protection for the data processing terminal.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
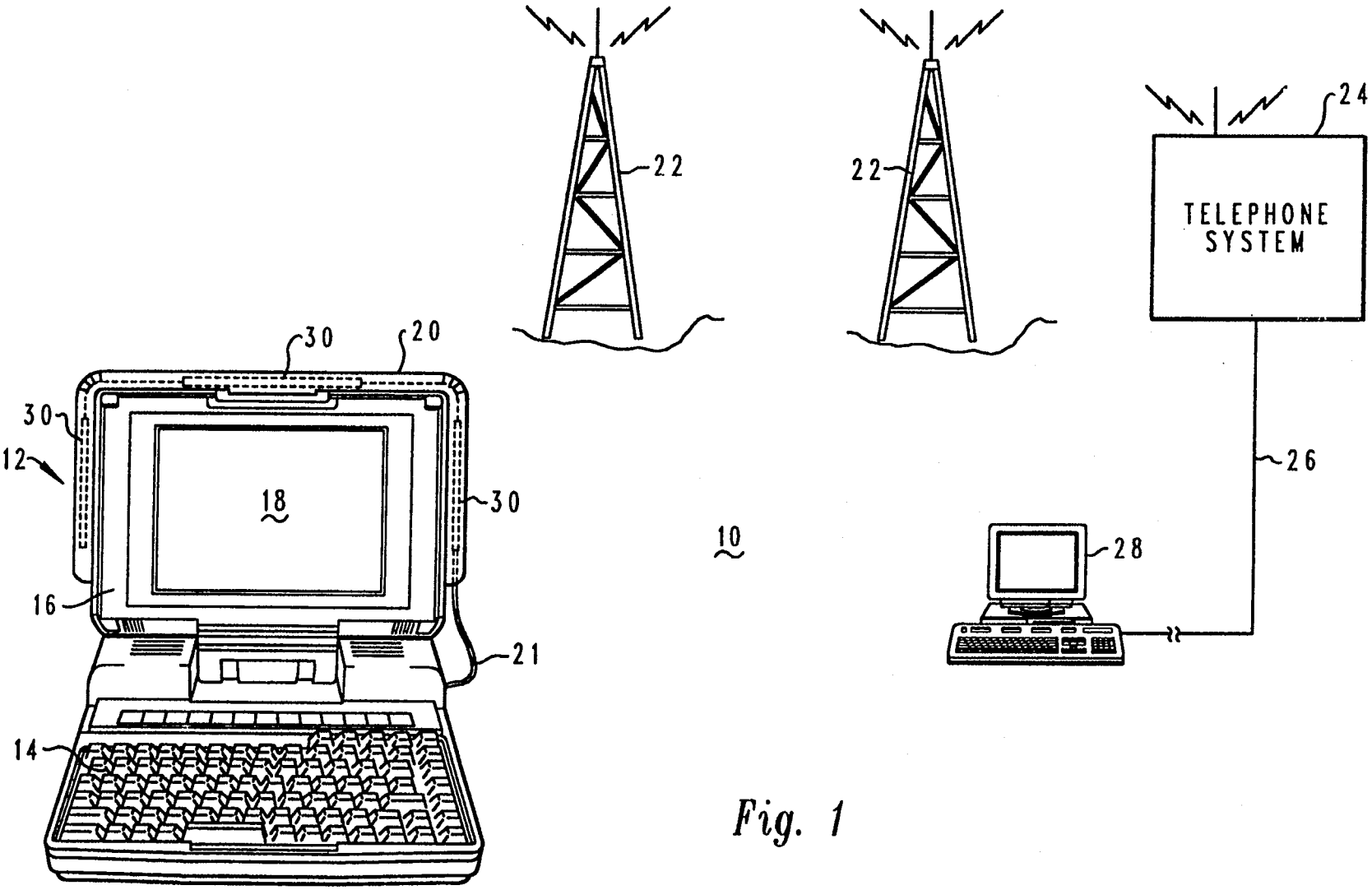
FIG. 1 is a partially schematic pictorial representation of a portable data processing terminal utilizing the external antenna of the present invention.

With reference now to the figures and in particular with reference to FIG. 1, there is depicted a partially schematic pictorial representation of a distributed data processing system 10 which may include a portable data processing terminal 12 which may utilize an external antenna in accordance with the present invention. Upon reference to the foregoing those skilled in the art will appreciate that while distributed data processing system 10 is illustrated as including only two computers, typically such distributed data processing systems include a large number of computers distributed over a wide geographic area. As illustrated, portable data processing terminal 12 is one of the computers within distributed data processing system 10. Portable data processing terminal 12 is preferably a battery powered laptop or notebook computer which includes a low power display system 16 which preferably provides a display screen 18 which may be implemented utilizing a liquid crystal display (LCD), a gas plasma display or any other suitable technology. Keyboard 14 is provided with portable data processing terminal 12 and enables the computer user to access and modify data stored within portable data processing terminal 12 in a manner well known in the art.

As those skilled in the art will appreciate it is increasingly common for computers such as portable computer 12 to include therein a miniature cellular telephone system (not shown) which is provided in conjunction with a modem. For example, it is possible to remove the fixed disk drive module typically provided with portable computer 12 and substitute therefore a module which includes a cellular transceiver and associated modem device. Those skilled in the art will appreciate that a modem is a device which may be utilized to convert digital data from a computer to an analog signal which may be transmitted via a telecommunications system. Additionally, such devices convert received analog signals from the telecommunications line to digital data which may be utilized by a computer. As is typical in such systems, a cellular telephone transmits a radio frequency signal via an external antenna 20 which is coupled to a cellular transceiver (not shown) via coaxial cable 21 and which may be implemented utilizing the antenna system disclosed herein. As illustrated, external antenna 20 preferably includes multiple antenna elements 30, depicted in phantom line within external antenna 20.

As is typical in such systems, a cellular telephone communications device transmits a radio frequency signal via an external antenna 20 which may be received and relayed via multiple cellular system antenna 22. Thus, digital data within portable data processing terminal 12 may be converted into a series of analog signals and transmitted, via a cellular telephone system and multiple intervening repeaters to a telephone system 24, in a manner well known to those skilled in the art.

Analog signals thus transmitted may be received by the telephone system and transmitted, via an ordinary telephone land line 26 to a computer 28 within distributed data processing system 10. While computer 28 is depicted as a personal computer, those skilled in the art will appreciate that computer 28 may be implemented utilizing a workstation, terminal or main frame computer, as desired. Typically, computer 28 will also include a modem device permitting data from portable data processing terminal 12 to be transmitted to and received by computer 28 and computer 28 may be linked to portable data processing terminal 12 utilizing cellular technology, 24 rather than telephone land lines.

Figure 2:
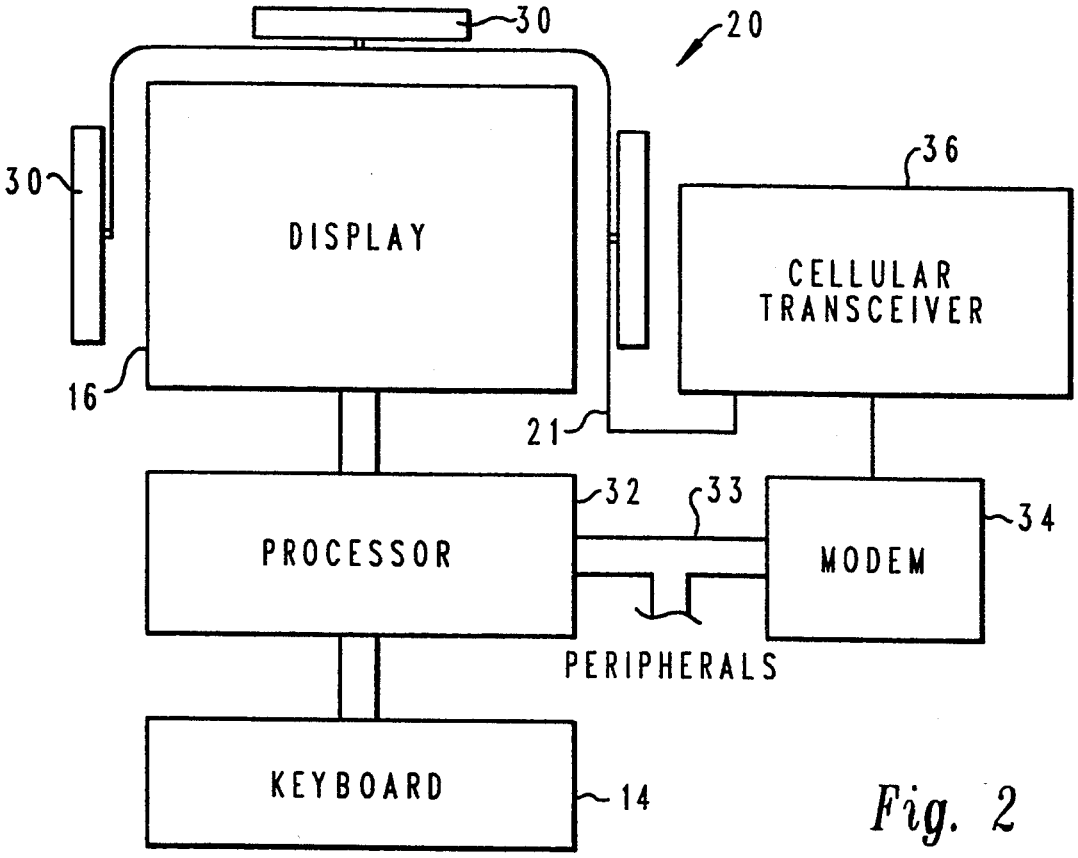
FIG. 2 is a block diagram of the major subsystems of the portable data processing terminal of FIG. 1.

Referring now to FIG. 2, there is depicted a block diagram of the major subsystem components of portable data processing terminal 12 of FIG. 1. As illustrated, keyboard 14 and display 16 are coupled to a processor 32. Processor 32 is coupled via bus 33 to modem device 34 which serves to convert digital data from processor 32 into analog data which may be transmitted via cellular transceiver 36. As depicted, cellular transceiver 36 is coupled via coaxial cable 21 to external antenna 20, which includes a plurality of antenna elements 30.

Figure 3:
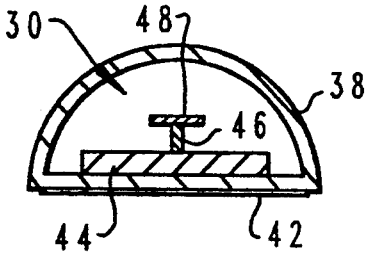
FIG. 3 is a sectional end view of one external antenna element of the external antenna of FIG. 1.

With reference now to FIG. 3, there is depicted a sectional end view of one antenna element 30 within the external antenna of FIG. 1. As illustrated, external antenna 20 preferably includes a flexible insulative elongate tubular member 38 which is preferably constructed of a foamed plastic, such as polyurethane, or any other suitable flexible insulative material having a dielectric constant of .001 or lower. As illustrated, the flat surface of flexible insulative elongate tubular member 38 preferably includes a strip of contact adhesive 42 which, in the depicted embodiment of the present invention, may be utilized to rapidly and efficiency mount external antenna 20 to the outer perimeter of display 16, as illustrated in FIG. 1. Disposed within flexible insulative elongate tubular member 38 is a ground plane 44, preferably constructed of copper or other highly conductive material, above which is mounted antenna element 48, at a fixed distance from copper ground plane ,14, utilizing radio frequency insulator 46. Thus, as those skilled in the art will appreciate upon reference to the foregoing, by disposing multiple antenna elements within flexible insulative elongate tubular member 38 and providing an adhesive backing strip 42, in the manner depicted, a multi-element external radio frequency antenna may be simply and efficiently mounted to multiple sides of portable data processing terminal 12, providing the necessary spatial diversity required to optimize communications efficiency utilizing a cellular communication system antenna.

Figure 4:
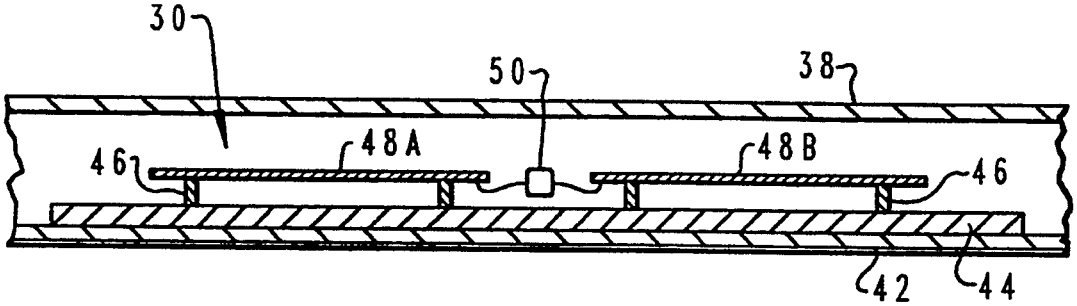
FIG. 4 is a sectional side view of the external antenna element of the external antenna of FIG. 1.

Referring now to FIG. 4, there is depicted a sectional side view of one antenna element 20 of external antenna 20 of FIG. 1. AS illustrated, antenna element 30 is disposed within a flexible insulative elongate tubular member 38, which is preferably D-shaped in the manner depicted herein. Each antenna element portion 48A and 48B may comprise a one/fourth wavelength antenna element which are coupled together, via coaxial connector 50, and mounted in fixed spatial relationship above copper ground plane 44 utilizing radio frequency insulators 46 in the manner depicted.

Upon reference to the foregoing those skilled in the art will appreciate that the Applicants herein have provided a novel multi-element radio frequency external antenna which is mounted within a flexible tubular member and which may be wrapped around multiple edges of a portable battery powered data processing terminal in a manner which efficiently provides the necessary separation and spatial diversity for optimum radio frequency communications. Those skilled in the radio frequency art will appreciate that multiple antenna elements must be separated by approximately ten inches in this frequency range or oriented at ninety degrees to each other in a manner easily provided utilizing the external antenna of the present invention.

While the invention has been particularly shown and described with reference to a preferred embodiment, it will be understood by those skilled in the art that various changes in form and detail may be made therein without departing from the spirit and scope of the invention.

We claim:

1. A multi-element radio frequency antenna adapted to be coupled to a radio frequency communication device within a generally rectangular mobile data terminal, said multi-element radio frequency antenna comprising:

a flexible insulative elongate tubular member;

means adapted to affix said flexible insulative elongate tubular member along at least two sides of an external surface of said generally rectangular mobile data terminal;

a plurality of antenna elements disposed in a spaced-apart relationship within said flexible insulative elongate tubular member; and means for electrically coupling said plurality of antenna elements to said radio frequency communication device within said generally rectangular mobile data terminal.

2. The multi-element radio frequency antenna according to claim 1, wherein said flexible insulative elongate tubular member comprises a flexible insulative tubular member having a D-shaped cross-section.

3. The multi-element radio frequency antenna according to claim 2, wherein said means adapted to affix said flexible insulative elongate tubular member along at least two sides of an external surface of said generally rectangular mobile data terminal comprises an adhesive backing along at least a portion of a flat surface of said D-shaped cross-section.

4. The multi-element radio frequency antenna according to claim 1, wherein said plurality of antenna elements disposed in spaced-apart relationship within said flexible insulative elongate tubular member comprises three antenna elements.

5. The multi-element radio frequency antenna according to claim 4, wherein said flexible insulative elongate tubular member comprises a flexible insulative elongate tubular member having a length greater than the greatest side of said generally rectangular mobile data terminal.

6. The multi-element radio frequency antenna according to claim 5, wherein each of said three antenna elements is disposed upon a separate side of said generally rectangular mobile data terminal when said flexible insulative elongate tubular member is affixed to said generally rectangular mobile data terminal.

7. A mobile data terminal comprising:

a generally rectangular case;

a radio frequency communication device within said generally rectangular case;

a flexible insulative elongate tubular member;

means for affixing said flexible insulative elongate tubular member along at least two sides of an external surface of said generally rectangular case;

a plurality of antenna elements disposed in a spaced-apart relationship within said flexible insulative elongate tubular member; and means for electrically coupling said plurality of antenna elements to said radio frequency communication device within said generally rectangular case.

8. The mobile data terminal according to claim 7, wherein said flexible insulative elongate tubular member comprises a flexible insulative tubular member having a D-shaped cross-section.

9. The mobile data terminal according to claim 8 wherein said means adapted to affix said flexible insulative elongate tubular member along at least two sides of an external surface of said generally rectangular case comprises an adhesive backing along at least a portion of a flat surface of said D-shaped cross-section.

10. The mobile data terminal according to claim 7, wherein said plurality of antenna elements disposed in a spaced-apart relationship within said flexible insulative elongate tubular member comprises three antenna elements.

* * * * *